US005325829A

United States Patent [19]

Iwasiuk

[11] Patent Number: 5,325,829

[45] Date of Patent: Jul. 5, 1994

[54] INTAKE MANIFOLD AIR INLET CONTROL ACTUATOR

[75] Inventor: Orest Iwasiuk, Farmington Hills, Mich.

[73] Assignee: Schmelzer Corporation, Oxford, Mich.

[21] Appl. No.: 951,632

[22] Filed: Sep. 25, 1992

[51] Int. Cl.[5] ..... F02D 9/00

[52] U.S. Cl. ..... 123/336; 123/432

[58] Field of Search ..... 123/308, 432, 337, 399, 123/400, 336

[56] References Cited

U.S. PATENT DOCUMENTS

| | | | |
|---|---|---|---|
| 2,371,336 | 3/1945 | Levon . | |
| 2,767,979 | 10/1956 | Hummert . | |
| 3,020,039 | 2/1962 | Hynes et al. . | |
| 3,320,698 | 5/1967 | Hummel . | |
| 3,452,479 | 8/1969 | Bentley . | |
| 3,481,076 | 12/1969 | Bedard . | |
| 3,534,630 | 10/1970 | Schwerdofer . | |
| 3,713,346 | 1/1973 | Chamberlain et al. . | |
| 4,068,799 | 1/1978 | Brodin . | |
| 4,186,524 | 2/1980 | Pelchat . | |
| 4,226,136 | 10/1980 | Porter et al. | 74/416 |
| 4,246,628 | 1/1981 | Ikemizu et al. . | |
| 4,249,771 | 2/1981 | Gergoe . | |
| 4,305,228 | 12/1981 | Nelson . | |
| 4,420,185 | 12/1983 | Bienert et al. . | |
| 4,471,251 | 9/1984 | Yamashita . | |
| 4,511,129 | 4/1985 | Kishino . | |
| 4,534,233 | 8/1985 | Hamaguchi . | |
| 4,617,897 | 10/1986 | Sasaki et al. | 123/432 |
| 4,860,493 | 8/1989 | Lense . | |
| 4,866,882 | 9/1989 | Cappello . | |
| 4,885,948 | 12/1989 | Thrasher, Jr. et al. . | |
| 4,903,435 | 2/1990 | Bittmann . | |
| 4,938,086 | 2/1990 | Nolte et al. . | |
| 4,970,826 | 11/1990 | Richmond et al. . | |
| 4,987,791 | 1/1991 | Nakahashi et al. . | |
| 5,027,769 | 7/1991 | Yoshida et al. | 123/399 |
| 5,036,816 | 8/1991 | Mann | 123/399 |
| 5,040,430 | 8/1991 | Adam et al. . | |
| 5,090,261 | 2/1992 | Nakatsukasa . | |
| 5,099,760 | 3/1992 | Schneider . | |
| 5,131,364 | 7/1992 | Mann | 123/399 |
| 5,150,680 | 9/1992 | Nishimura | 123/399 |
| 5,161,419 | 11/1992 | May et al. . | |
| 5,167,211 | 12/1992 | Fukuma et al. | 123/308 |
| 5,168,951 | 12/1992 | Sugiura et al. | 123/399 |
| 5,178,112 | 1/1993 | Terazawa et al. | 123/400 |
| 5,178,113 | 1/1993 | Lott et al. | 123/399 |
| 5,203,113 | 4/1993 | Yagi | 49/324 |

FOREIGN PATENT DOCUMENTS

| | | |
|---|---|---|
| 0170989 | 7/1985 | European Pat. Off. . |
| 339928 | 4/1989 | European Pat. Off. . |
| 3522706 | 6/1985 | Fed. Rep. of Germany . |
| 3741615 | 12/1987 | Fed. Rep. of Germany . |
| 11070 | 5/1911 | United Kingdom . |
| 531285 | 7/1939 | United Kingdom . |
| 624189 | 1/1946 | United Kingdom . |
| 688417 | 9/1950 | United Kingdom . |
| 1335421 | 4/1971 | United Kingdom . |
| 2195392 | 12/1985 | United Kingdom . |
| 2167120 | 5/1986 | United Kingdom . |
| 2169652 | 7/1986 | United Kingdom . |
| 2212591 | 12/1988 | United Kingdom . |

*Primary Examiner*—E. Rollins Cross
*Assistant Examiner*—Erick Solis
*Attorney, Agent, or Firm*—Myron B. Kapustij; Malcolm L. Sutherland

[57] ABSTRACT

An actuator for controlling the flow of air through an air inlet port, particularly a secondary air inlet port, in an intake manifold in an internal combustion engine. The actuator actuates means disposed in the throat of the inlet port for opening and closing said port. The actuator comprises a housing, a reversible motor disposed in the housing, power transmission means with said motor comprising a non-planetary gear train disposed in the housing, and a shaft rotatably mounted in the housing operably engaged at one end thereof with the power transmission means and at its other end with the means for opening and closing the air inlet port.

13 Claims, 2 Drawing Sheets

INTAKE MANIFOLD AIR INLET CONTROL ACTUATOR

FIELD OF THE INVENTION

The present invention relates to an intake manifold inlet air control actuator for internal combustion engines, and more particularly to an actuator for controlling the flow of air through a secondary air inlet port in an intake manifold in engines with multiple air inlet ports per cylinder.

BACKGROUND OF THE INVENTION

On automotive engines with multiple air inlet ports per cylinder the amount of air entering the cylinder through the secondary air inlet port is generally varied depending upon engine operating conditions. Thus, a control system must be utilized to open and close the secondary air inlet port to vary the amount of air passing therethrough. Current control systems utilize a vacuum actuator to open or close the secondary air inlet port thereby controlling the amount of air passing through the secondary air inlet port into the cylinder. However, under certain conditions the force achievable with a vacuum actuator is insufficient to satisfactorily open and close the secondary air inlet port in the intake manifold.

What is needed, therefore, is an actuator which is simple, compact, lightweight, reliable and yet provides sufficient torque and speed to satisfactorily open and close the secondary air inlet port. The present invention provides such an actuator.

SUMMARY OF THE INVENTION

In accordance with the present invention there is provided an actuator for opening and closing a secondary air inlet port in an intake manifold. The actuator comprises driving means comprised of a reversible electric motor; power transmitting means engaged with the driving means and with a rotary shaft for transmitting power from said driving means to said rotary shaft; and a rotary shaft interfacing with a control shaft mounted in the intake manifold which controls the opening and closing of the secondary air intake port. The power transmitting means comprises a non-planetary gear train engaged at one end thereof with the driving means and at the other end with the rotary shaft. The rotary shaft is in turn engaged with the control shaft in the intake manifold.

The control shaft has attached thereto plates which fit into the throat of the secondary air intake ports and which rotate along with the control shaft. Rotation of the control shaft rotates these plates to either open or close, depending upon the direction of rotation of the secondary air intake ports.

DESCRIPTION OF THE PREFERRED EMBODIMENT

Figure 2:
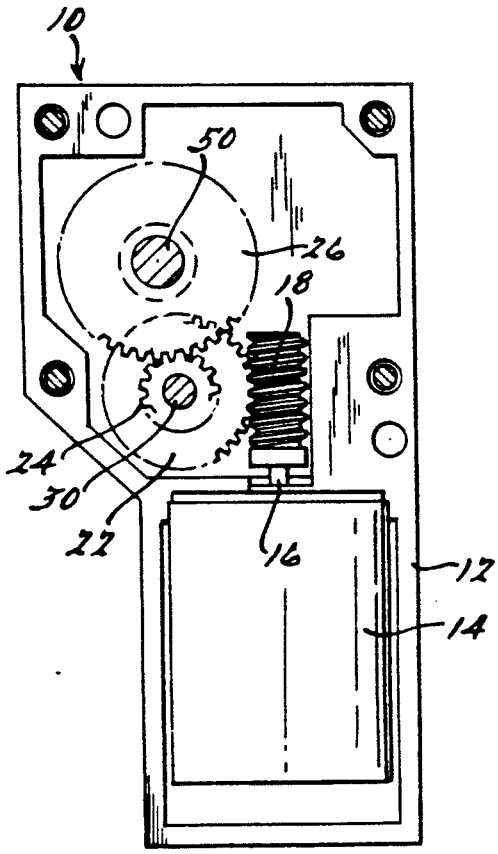
FIG. 2 is a cross-sectional view on an enlarged scale taken along lines 2—2 of FIG. 1.
Figure 3:
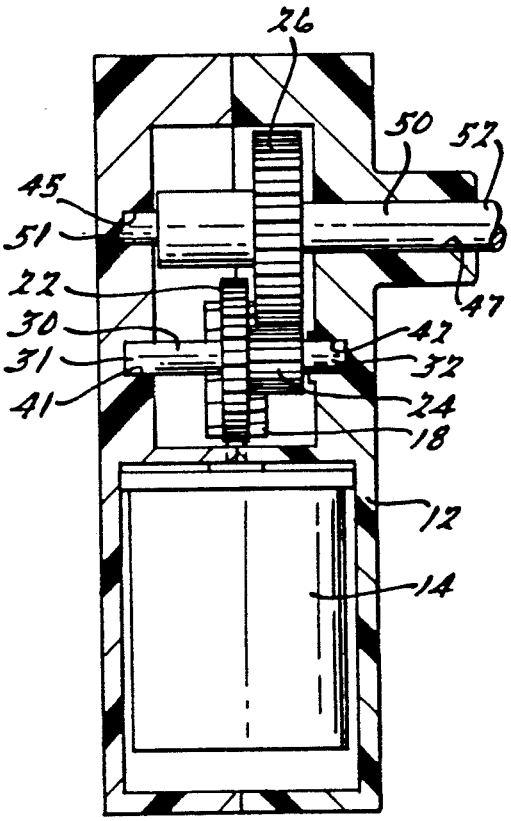
FIG. 3 is a top plan view on an enlarged scale of the actuator of FIG. 1 with the top of the housing cut away to show the motor and gear train.

As best shown in FIGS. 2 and 3 of the drawings the actuator comprises a housing 12 having an electric motor 14 mounted therein. The motor 14 is reversible and has circuit means associated therewith, including switch means for selectively activating the motor in either direction.

An output shaft 16 is rotated by the motor 14. A worm 18 is disposed on output shaft 16. In a preferred embodiment worm 18 is separate from output shaft 16 and is fixedly mounted on output shaft 16 for rotation therewith. Worm 18 meshes with and drives worm gear 22 of gear train 20.

Gear train 20 is a non-planetary gear train. A planetary gear train, as is well known to those skilled in the art, consists of a central sun gear, ring gear, and arm with planet gears which engage the sun gear and the ring gear. Each of these three elements may act as drive, output or may be at rest. A planetary gear train is disclosed in German published application DE 3741-615-A. Gear train 20, on the other hand, does not contain a central sun gear, a ring gear, or planet gears engaging the sun gear and the ring gear.

Gear train 20 is operatively engaged at one end thereof with worm 18 of output shaft 16 of motor 14 and at the other end with rotary shaft 50. Gear train 20 is comprised of worm gear 22, gear 24, and gear 26. As best seen in FIG. 3 worm gear 22 and gear 24 are coaxially disposed on gear shaft 30. Gear shaft 30 is rotatably mounted at its two ends 31 and 32 in bearings 41, 42 in housing 12. Gear 26 is fixedly disposed against rotation on rotary shaft 50. Rotary shaft 50 is rotatably mounted in housing 12. One end 51 of rotary shaft 50 is rotatably mounted in bearing 45 in housing 12. The other end 52 of rotary shaft 50 is supported by bearing 47 and extends outside of housing 12.

Rotation of output shaft 16 results in rotation of worm 18. When worm 18 rotates its teeth mesh with the teeth of worm gear 22 thereby causing rotation of worm gear 22 with which worm 18 meshes. Rotation of worm gear 22 rotates gear shaft 30 on which worm gear 22 is disposed. Rotation of gear shaft 30 causes rotation of gear 24. Rotation of gear 24 causes gear 26, with which gear 24 meshes, to rotate. Rotation of gear 26 results in rotation of rotary shaft 50 on which gear 26 is non-rotatably mounted.

Figure 4:
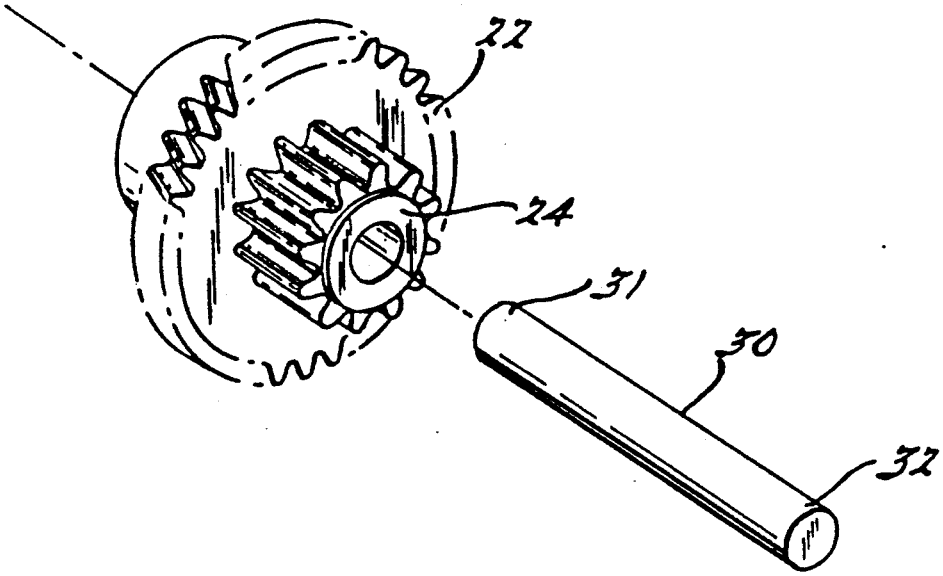
FIG. 4 is an exploded perspective view on an enlarged scale of the embodiment wherein the worm gear and another gear are of integral construction and the shaft on which they freely rotate.

In a preferred embodiment worm gear 22 and gear 24 may be formed integrally or may be joined together and be freely rotatably mounted on shaft 30. Such a construction of worm gear 22 and gear 24 is illustrated in FIG. 4.

In such a construction rotation of worm 18 causes rotation of worm gear 22 about shaft 30. Since worm gear 22 is integrally formed with gear 24 rotation of worm gear 22 results in rotation of gear 24. Rotation of gear 24 results in rotation of rotary shaft gear 26, with which gear 24 is in meshing engagement. Since gear 26 is non-rotatably mounted on rotary shaft 50, when gear 26 is rotated rotary shaft 50 also rotates.

Figure 5:
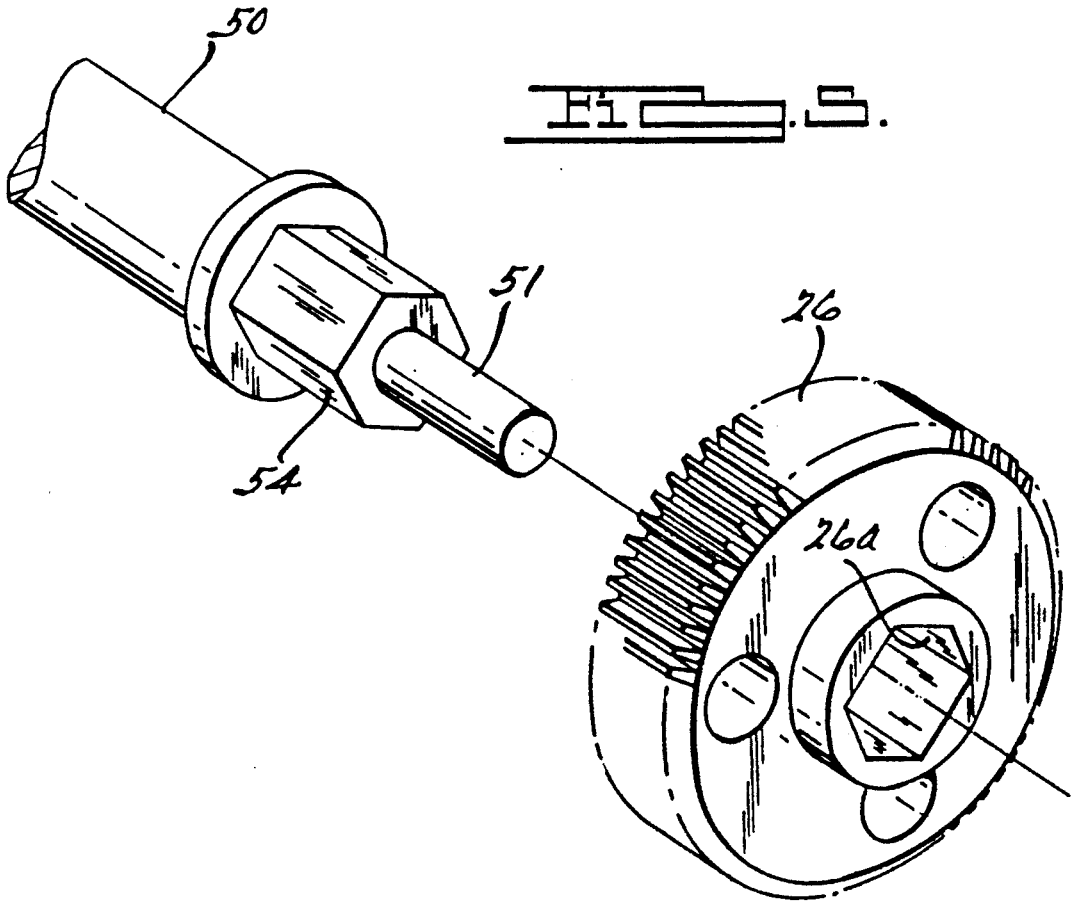
FIG. 5 is an exploded perspective view on an enlarged scale of one embodiment of the rotary shaft and the rotary shaft gear.

As illustrated in the embodiment of FIG. 5 the rotary shaft 50 may be of unitary construction with gear 26 non-rotatably mounted on shaped section 54 via a complementary shaped central opening 26*a*. Shaft 50 is rotatably mounted in bearing 45 via reduced diameter portion 51.

Rotation of rotary shaft 50 rotates shaft 100 to which rotary shaft 50 is attached by attachment means 200. Rotation of shaft 100 causes plates 410, 412, mounted on shaft 100 by mounting means 430 such as screws, disposed in secondary air inlet ports 406, 408 to rotate about an axis comprised of the shaft 100 thereby opening or closing the secondary air inlet ports 406, 408. For example, clockwise rotation of shaft 100 results in clockwise rotation of plates 410, 412 thereby opening the secondary air inlet ports 406, 408. Counterclockwise rotation of shaft 100 results in counterclockwise rotation of plates 410, 412 thereby closing the secondary air inlet ports 406, 408. Plates 410, 412 are, in effect, butterfly valves located in the throats of air inlet ports 406, 408.

Figure 1:
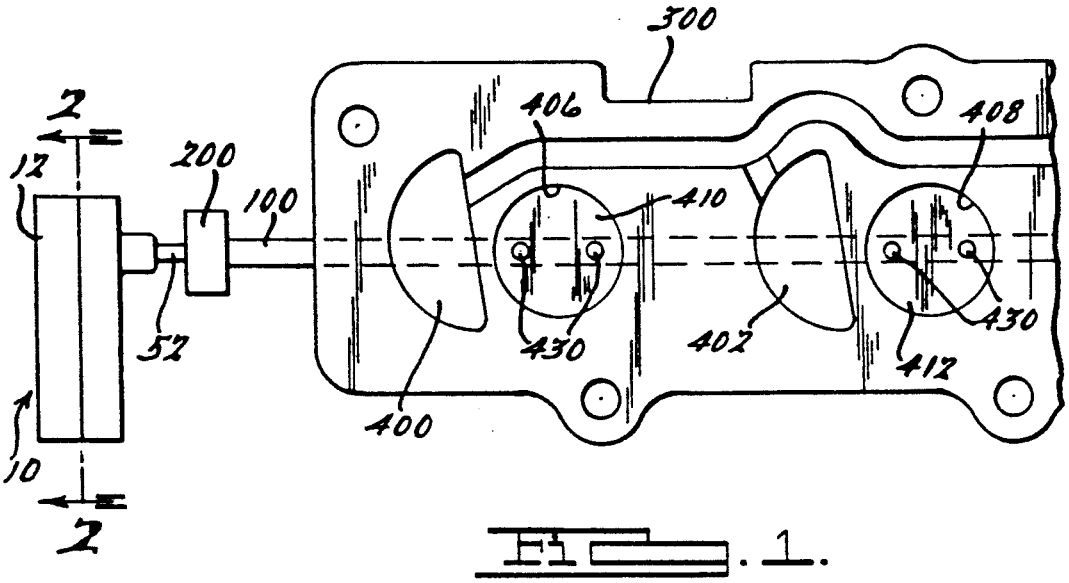
FIG. 1 is a top plan view of the actuator interfacing with the control shaft in the inlet manifold. Also illustrated in FIG. 1 are the plates disposed in the throats of the secondary air inlet ports. The plates are illustrated in the closed position.

The plates 410, 412 and inlet ports 406, 408 and their operation are well known to those skilled in the art. As illustrated in FIG. 1 the plates are in the closed position when they are substantially perpendicular to the walls of the air inlet ports. In the closed position they seal the throats of the air inlet ports preventing air from passing through said inlet ports. Rotation of the plates, as for example, when they are substantially parallel to the walls of the inlet ports, results in opening of the secondary air inlet ports and allows passage of air therethrough.

What is claimed is:

1. An actuator for opening and closing throttle valves, said valves fixedly disposed on a rotatable throttle shaft, in a plurality of air inlet ports in an intake manifold of an internal combustion engine comprising:

a housing;

a reversible motor disposed in said housing;

power transmission means operably engaged with said motor comprising a non-planetary gear train containing a plurality of gears including a worm gear disposed in said housing;

a rotary shaft having a longitudinal axis rotatably mounted in said housing operably engaged at one end thereof with said power transmission means so that operation of said power transmission means rotates said rotary shaft about its longitudinal axis, and operably engaged at the other end with said throttle shaft whereby rotation of said rotary shaft rotates said throttle shaft thereby opening and closing said air inlet ports.

2. The actuator of claim 1 wherein said motor has an output shaft having a worm thereon, said worm being in meshing engagement with said worm gear.

3. The actuator of claim 2 wherein said gear train includes a gear non-rotatably mounted on said rotary shaft.

4. The actuator of claim 3 which includes a gear rotatable with said worm gear and in meshing engagement with said gear on said rotary shaft.

5. The actuator of claim 1 wherein said motor is an electric motor.

6. The actuator of claim 1 wherein the teeth of each gear are engaged with the teeth of only one other gear.

7. The actuator of claim 4 wherein the teeth of each gear are engaged with the teeth of only one other gear.

8. A vehicle internal combustion engine air intake system which includes an intake manifold having a plurality of air intake ports and means for opening and closing at least some of said air intake ports comprising a throttle shaft extending through said intake ports, and throttle valves attached to said throttle shaft disposed in the throats of at least some of said air intake ports whereby rotation of said throttle shaft rotates said throttle valves in said throats thereby opening or closing said air intake ports, the air intake system further comprising:

an actuator for actuating said means for opening and closing said air inlet ports comprising a housing;

a reversible electric motor;

power transmission means operably engaged with said motor comprising a non-planetary gear train containing a plurality of gears including a worm gear disposed in said housing;

a rotary shaft having a longitudinal axis rotatably mounted in said housing operably engaged at one end with said power transmission means whereby operation of said power transmission means rotates said rotary shaft about its longitudinal axis, and operably engaged at the other end with said throttle shaft whereby rotation of said rotary shaft rotates said throttle shaft.

9. The air intake system of claim 8 wherein said motor has an output shaft having a worm thereon, said worm being in meshing engagement with said worm gear.

10. The air intake system of claim 9 wherein said gear train includes a gear non-rotatably mounted on said rotary shaft.

11. The air intake system of claim 10 which includes a gear rotatable with said worm gear and in meshing engagement with said gear on said rotary shaft.

12. The air intake system of claim 8 wherein the teeth of each gear are engaged with the teeth of only one other gear.

13. The air intake system of claim 11 wherein the teeth of each gear are engaged with the teeth of only one other gear.

* * * * *